US005954131A

United States Patent [19]

Sallwasser

[11] Patent Number: 5,954,131

[45] Date of Patent: Sep. 21, 1999

[54] METHOD AND APPARATUS FOR CONVEYING A LOGGING TOOL THROUGH AN EARTH FORMATION

[75] Inventor: Alan J. Sallwasser, Houston, Tex.

[73] Assignee: Schlumberger Technology Corporation, Houston, Tex.

[21] Appl. No.: 08/924,672

[22] Filed: Sep. 5, 1997

[51] Int. Cl.[6] ..... E21B 47/00

[52] U.S. Cl. ..... 166/254.2; 166/206; 175/96; 175/230

[58] Field of Search ..... 166/254.2, 206, 166/209; 175/94–99, 230; 405/156, 154

[56] References Cited

U.S. PATENT DOCUMENTS

| | | | |
|---|---|---|---|
| 3,827,512 | 8/1974 | Edmond . | |
| 3,888,319 | 6/1975 | Bourne et al. | 175/94 X |
| 4,031,750 | 6/1977 | Youmans et al. . | |
| 4,071,086 | 1/1978 | Bennett . | |
| 4,095,655 | 6/1978 | Still | 175/94 X |
| 4,141,414 | 2/1979 | Johansson | 175/94 X |
| 4,192,380 | 3/1980 | Smith | 166/254.2 |
| 4,460,920 | 7/1984 | Weber et al. . | |
| 4,463,814 | 8/1984 | Horstmeyer et al. . | |
| 4,570,709 | 2/1986 | Wittrisch | 166/254.2 |
| 4,643,377 | 2/1987 | Christianson . | |
| 4,686,653 | 8/1987 | Staron et al. . | |
| 5,018,451 | 5/1991 | Hapstack . | |
| 5,121,694 | 6/1992 | Zollinger . | |
| 5,375,668 | 12/1994 | Hallundbaek . | |
| 5,794,703 | 8/1998 | Newman et al. . | |

OTHER PUBLICATIONS

"Well Tractor", Welltec Well Technologies, Statoil, Denmark.

K. Ostvang, J. Haukvik, T. Skeie, & J. Hallundbaek, "Wireline Tractor Operations Successful in Horizontal Wells", Apr., 1997, World Oil, pp. 125–132.

*Primary Examiner*—Dennis L. Taylor

*Attorney, Agent, or Firm*—Brigitte L. Jeffery; John J. Ryberg

[57] ABSTRACT

A conveyance apparatus for conveying at least one logging tool through an earth formation traversed by a horizontal or highly deviated borehole is disclosed. The conveyance apparatus comprises a pair of arcuate-shaped cams pivotally mounted to a support member, means for biasing the arcuate surface of each cam into contact with the borehole wall, and actuators operatively connected to each cam. A logging tool is attached to the conveyance apparatus. When either actuator is activated in a first direction, the cam connected to the activated actuator is linearly displaced forward and the arcuate surface of the cam slides along the borehole wall. When either actuator is activated in a second direction, the activated actuator pulls the connected cam backwards and the biasing means thereby urges the arcuate surface of the cam to lock against the borehole wall. Once the cam is locked, further movement of the actuator propels both the conveyance apparatus and the logging tool forward along the highly deviated or horizontal borehole.

16 Claims, 3 Drawing Sheets

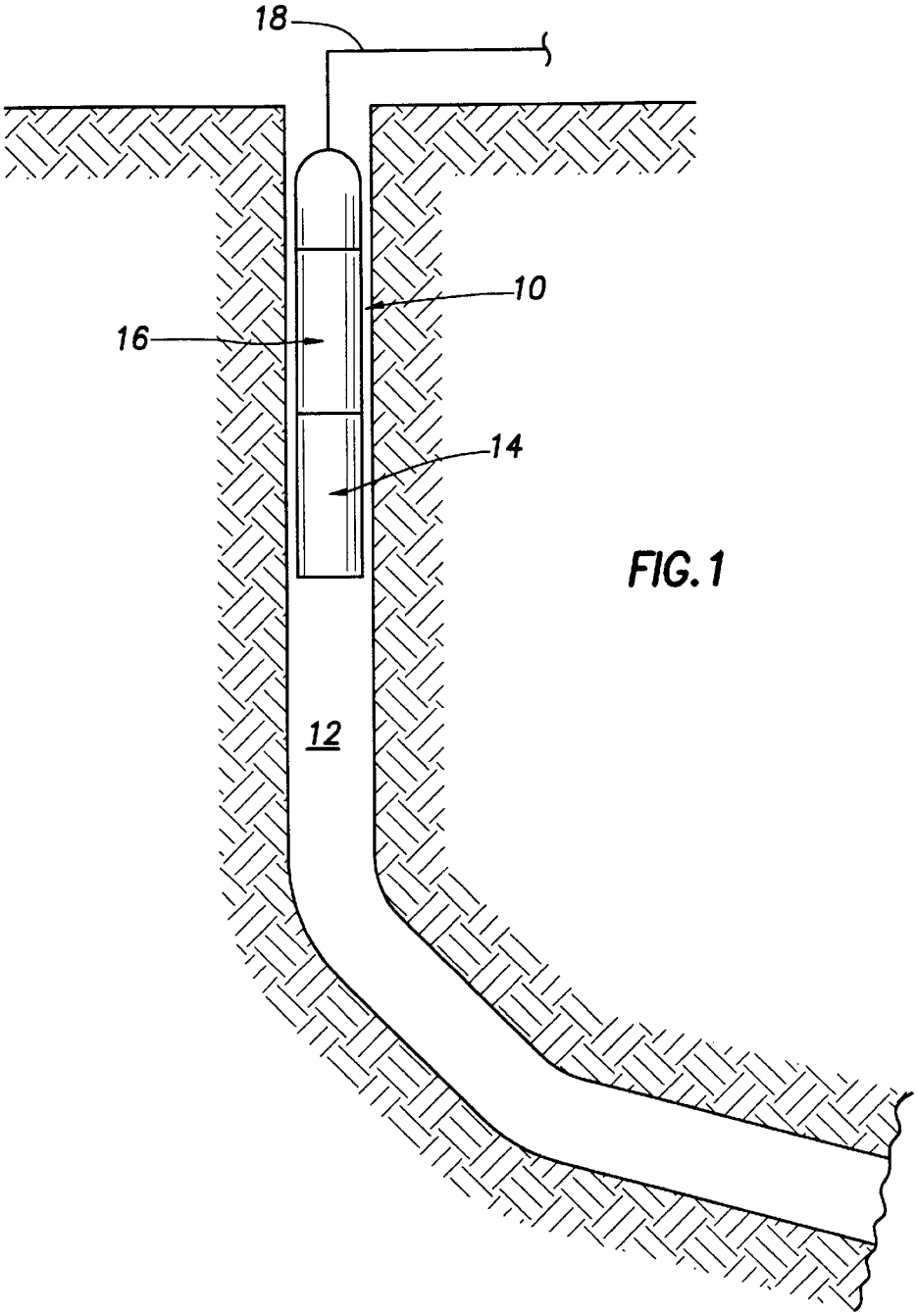
FIG. 1
FIG. 2
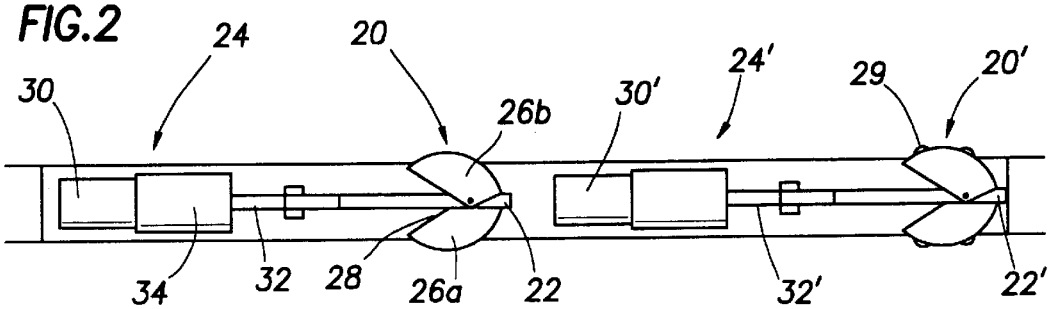

METHOD AND APPARATUS FOR CONVEYING A LOGGING TOOL THROUGH AN EARTH FORMATION

BACKGROUND OF THE INVENTION

The present invention relates generally to a logging tool conveyance system, and more particularly, to a method and apparatus for conveying a logging tool through an earth formation traversed by a horizontal or highly deviated borehole.

To economically produce hydrocarbons from a reservoir, it has become increasingly common to drill a borehole, through an earth formation, which deviates from the traditional vertical orientation. The deviation may result from drilling a borehole using either a sharp or gradually increasing angle away from the vertical axis. The deviation may also result from drilling a borehole which extends horizontally from the vertical axis. It is well known in the art to attempt the logging of formations surrounding such deviated or horizontal boreholes with logging tools lowered into the wellbore on a wireline and/or a cable. Such tools usually depend upon the force of gravity to permit positioning of the tool within the borehole. However, when the borehole is drilled at a sufficiently high angle, the force of gravity on the tool and wireline is insufficient to overcome the friction encountered by the tool and wireline against the highly deviated portion of the borehole wall. Stiff devices, such as drill pipe and coiled tubing, have been used for conveyance of logging tools in horizontal and highly deviated boreholes. Often times, many hours of work are required to convey logging tools in this fashion. Furthermore, coiled tubing conveyance is limited in reach due to helical buckling. Thus, it has become essential to provide an economical and expedient means of conveying a logging tool through the horizontal or highly deviated portion of a borehole.

SUMMARY OF THE INVENTION

The above disadvantages of the prior art are overcome by means of the subject invention for an apparatus and method for conveying at least one logging tool through an earth formation traversed by a horizontal or highly deviated borehole. The conveyance apparatus comprises a pair of arcuate-shaped cams pivotally mounted to a support member, means for biasing the arcuate surface of each cam into contact with the borehole wall, and actuators operatively connected to each cam. A logging tool is attached to the conveyance apparatus. When either actuator is activated in a first direction, the cam connected to the activated actuator is linearly displaced forward and the arcuate surface of the cam slides along the borehole wall. When either actuator is activated in a second direction, the activated actuator pulls the connected cam backwards and the biasing means thereby urges the arcuate surface of the cam to lock against the borehole wall. Once the cam is locked, further movement of the actuator propels both the conveyance apparatus and the logging tool forward along the highly deviated or horizontal borehole.

The method for conveying at least one logging tool through an earth formation traversed by a horizontal or highly deviated borehole comprises the step of providing a conveyance apparatus having a pair of arcuate-shaped cams pivotally mounted to a support member, means for biasing the arcuate surface of each cam into contact with the borehole wall, and actuators operatively connected to each cam. At least one logging tool is attached to the conveyance apparatus.

In the preferred embodiment, the pair of cams are simultaneously operated. The actuator for a first cam is activated to displace the first cam in a forward direction. Simultaneously, the actuator for a second cam is activated to pull the second cam backward thereby locking the arcuate portion against the borehole wall and propelling the conveyance apparatus and logging tool forward. These actions are reversed such that the actuator for the first cam is activated to pull the first cam backward thereby locking the arcuate portion against the borehole wall and propelling the conveyance apparatus and logging tool forward while the actuator for the second cam is activated to displace the second cam in a forward direction. These steps are repeated until the logging tool is conveyed to a predetermined position.

In a second embodiment of the invention, the pair of cams are first simultaneously operated. The actuator for each cam is simultaneously activated to pull each cam backward thereby locking the arcuate portions against the borehole wall and propelling the conveyance apparatus and logging tool forward. Next, the actuators are sequentially activated to displace each cam in a forward direction. These steps are repeated until the logging tool is conveyed to a predetermined position.

In a third embodiment of the invention, one actuator is reciprocated while the other actuator remains stationary. The moving actuator is activated to pull the cam backward thereby locking the arcuate portion against the borehole wall and propelling the conveyance apparatus and logging tool forward. The moving actuator is then activated to displace the cam in the forward direction. These steps are repeated until the logging tool is conveyed to a predetermined position.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

In the drawings:

FIG. 1 illustrates a tool string in a deviated borehole;

FIG. 2 illustrates the conveyance apparatus of the subject invention;

DETAILED DESCRIPTION OF THE PREFERRED EMBODIMENT

Figure 3A:
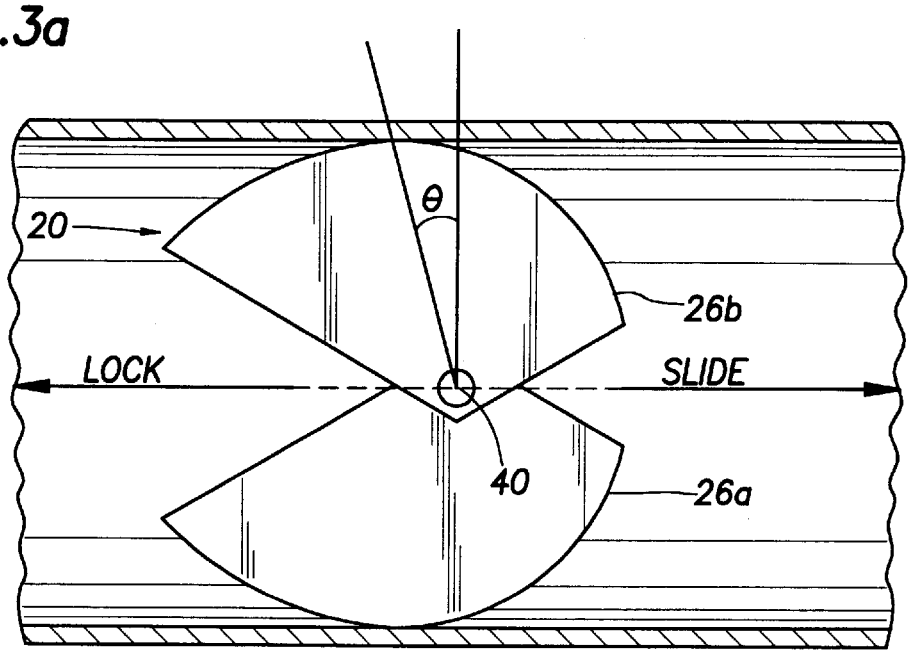
FIGS. 3*a*–3*b* depict the conveyance apparatus within a small and large diameter borehole; and, FIGS. 4*a*–4*c* illustrate position, velocity, and force versus time for continuous movement of a conveyance apparatus having a pair of cams.

FIG. 1 schematically illustrates tool string 10 in a deviated borehole 12. The borehole 12 is typically lined with steel casing cemented in place to the formation and may further include production tubing. However, it is within contemplation of the subject invention to have an open hole well. The tool string 10 comprises at least one logging tool 14 attached by suitable means to a conveyance apparatus 16. The tool string 10 also includes electronics for supplying power to the conveyance apparatus 16. The tool string 10 is suspended by an armored cable 18. A winch (not shown) is located at the surface and is used to lower and raise the tool string 10 in the vertical portion of borehole 12. In a preferred embodiment of the invention, logging tool 14 is located at a distal end of the tool string 10 and the conveyance apparatus 16 is located at a proximal end of the tool string 10. Alternatively, logging tool 14 is located at a proximal end of the tool string 10 and the conveyance apparatus 16 is located at a distal end of the tool string 10.

Referring to FIG. 2, the conveyance apparatus 16 comprises an actuator 24 for linearly displacing cam 20 which is pivotally mounted about a support frame 22. Cam 20 consists of a strong, corrosion and wear resistant material, such as stainless steel. Cam 20 comprises a pair of opposing members 26*a* and 26*b* having an arcuate surface and a means for biasing an arcuate portion of the cam 20 into contact with a wall of the borehole 12. Preferably, the biasing means comprise a spring 28 placed between each member 26*a* and 26*b* and the support frame 22. Spring 28 may consist of a torsion, extension, or compression spring. In an alternative embodiment of the invention, spring 28 is placed between members 26*a* and 26*b* to bias the opposing members against each other and into contact with a wall of borehole 12. Other means for biasing cam 20 against the borehole 12, including an electromechanical or hydraulic system, are within contemplation of this invention. To further improve the contact between the cam 20 and the borehole 12, cam 20 may have studded or particle members 29 fixably attached to the arcuate surface. Studs or particles 29 consist of a material having high hardness and abrasion resistance properties, such as tungsten carbide.

Still referring to FIG. 2, actuator 24 is operatively connected to cam 20. Actuator 24 comprises a motor 30 for rotating screw 32. The actuator 24 may further comprise a reduction gear box 34 disposed between motor 30 and screw 32. Alternatively, actuator 24 may consist of other means for linearly displacing cam 20, including, but not limited to, a hydraulic piston powered by a motor driven, hydraulic pump. When the motor 30 is rotated in one direction, screw 32 linearly displaces the cam 20 forward and the arcuate portion slidingly engages the borehole wall. When the motor 30 is rotated in the opposite direction, screw 32 pulls cam 20 backward and locks the arcuate portion against the borehole wall 12 and propelling the conveyance apparatus and logging tool forward.

Figure 3B:
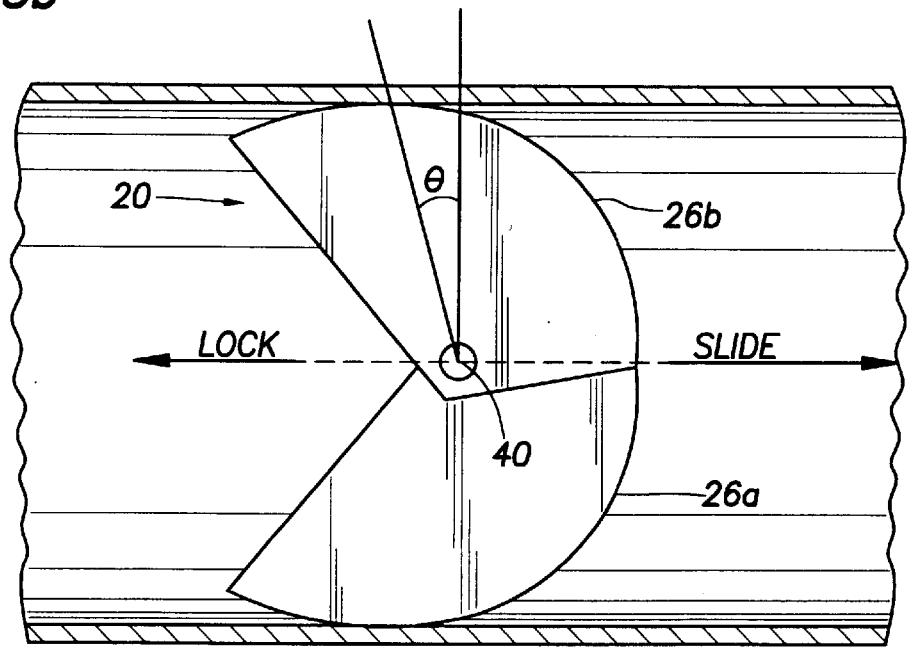

The conveyance apparatus 16 locks or slidingly engages the borehole wall for a variable diameter borehole 12. FIGS. 3*a*-3*b* depict the conveyance apparatus 16 within a small and large diameter borehole 12. The contact angle, θ, is between a point where an arcuate portion of cam 20 contacts the borehole wall and a line drawn through the pivot point 40 and perpendicular to the borehole wall 12. The contact angle required to lock cam 20 against the borehole wall relates to the friction characteristics between cam 20 and the borehole wall 12. The tangent of the contact angle, θ, must be smaller than the coefficient of friction between the cam and the borehole wall 12 so that actuator 24 locks cam 20 against the borehole wall. To accommodate a variable diameter borehole, the contact angle remains constant as cam 20 pivots inwardly or outwardly to accommodate the borehole diameter.

In a preferred embodiment, the conveyance apparatus 16 comprises a pair of actuators 24, 24' for linearly displacing cams 20, 20' which are pivotally mounted about a support frame 22, 22'. The action of sliding one cam 20 or 20' forward applies a reaction force against the conveyance apparatus 16 and logging tool 14 tending to move the apparatus 16 and logging tool 14 backwards. Similarly, tension in the wireline 18 being pulled into a highly deviated or horizontal section of the borehole 12 also tend to move the apparatus 16 and tool 14 backwards. The other cam 20' or 20, which is locked against the borehole wall 12 and not sliding forward, prevents backward movement of the apparatus 16 and logging tool 14.

Figure 4A:
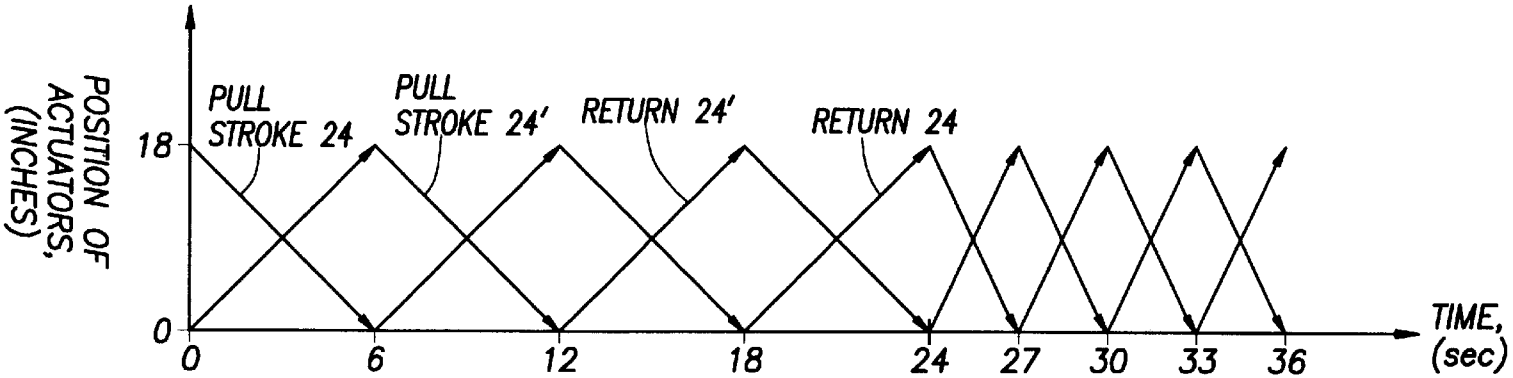
Figure 4B:
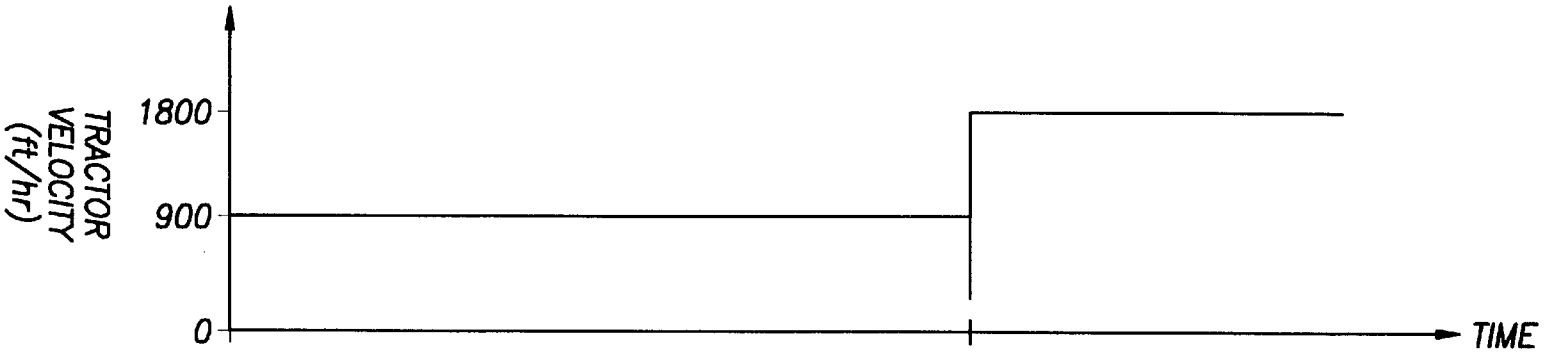
Figure 4C:
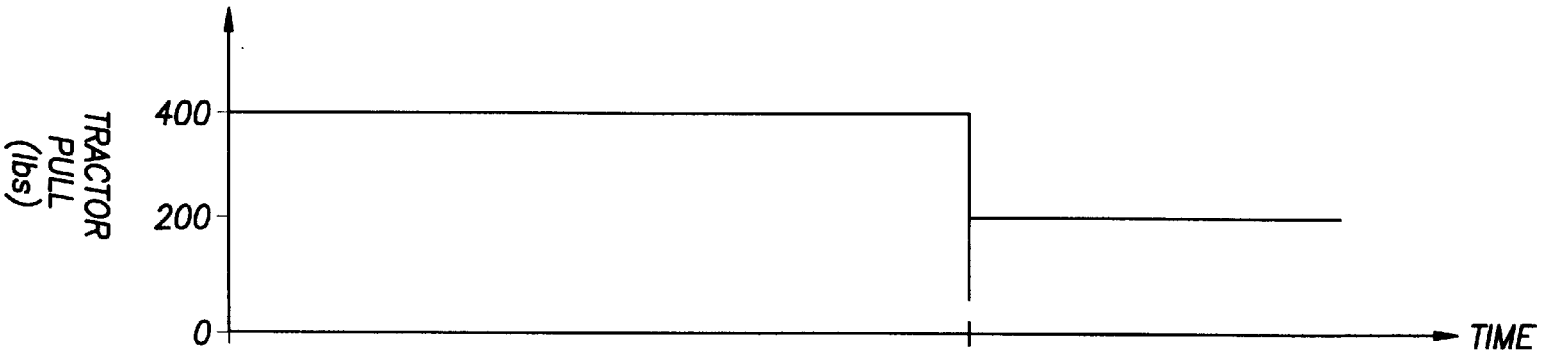

FIGS. 4*a*–4*c* illustrate position, velocity, and force versus time for continuous movement of the preferred conveyance apparatus 16. In the home position, at t=0, the first actuator 24 is fully extended for a distance approximately equal to the length of screw 32. Also, in the home position, the second actuator 24' is fully retracted. In order to convey the logging tool 14, a first motor 30 rotates in one direction and retracts screw 32 which pulls cam 20 backward and locks the arcuate portion against the borehole wall 12 and propels the conveyance apparatus and logging tool forward. Simultaneously, a second motor 30' rotates in one direction and screw 32' linearly displaces the cam 20' forward and the arcuate portion slidingly engages the borehole wall 12. These actions are then reversed such that the first motor 30 rotates in the opposite direction and screw 32 linearly displaces the cam 20 forward and the arcuate portion slidingly engages the borehole wall 12 and simultaneously, the second motor 30' rotates in the opposite direction and retracts screw 32 which pulls cam 20' backward and locks the arcuate portion against the borehole wall and propels the conveyance apparatus and logging tool forward. FIGS. 4*b*–4*c* show that the net motion of the conveyance apparatus 16 and logging tool 14 are continuous and the speed is inversely proportional to the pulling effort thereby reflecting the ability to supply a limited amount of electrical power via the wireline 18.

In a second embodiment of the invention, the pair of cams 20, 20' are first operated simultaneously, then sequentially. The actuator 24, 24' for each cam 20, 20' is simultaneously activated to pull each cam 20, 20' backward thereby locking the arcuate portions against the borehole wall 12 and propelling the conveyance apparatus 16 and logging tool 14 forward. Next, the actuators 24, 24' are sequentially activated to displace each cam 20, 20' in a forward direction. These steps are repeated until the logging tool 14 is conveyed to a predetermined position.

In a third embodiment of the invention, one actuator 24 or 24' is reciprocated while the other actuator 24 or 24' remains stationary. The moving actuator 24 or 24' is activated to pull the cam 20 or 20' backward thereby locking the arcuate portion against the borehole wall 12 and propelling the conveyance apparatus 16 and logging tool 14 forward. The moving actuator 24 or 24' is then activated to displace the cam 20 or 20' in the forward direction. These steps are repeated until the logging tool 14 is conveyed to a predetermined position.

The foregoing description of the preferred and alternate embodiments of the present invention have been presented for purposes of illustration and description. It is not intended to be exhaustive or limit the invention to the precise form disclosed. Obviously, many modifications and variations will be apparent to those skilled in the art. The embodiments were chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What I claim is:

1. An apparatus for conveying at least one logging tool through an earth formation traversed by a horizontal or deviated borehole, comprising;

a) a cam pivotally mounted to a support member, the cam having means for biasing an arcuate portion of the cam into contact with a wall of the borehole, the cam constructed and arranged such that its arcuate portion, so biased, will be locked against the wall When the cam is displaced in one direction along the borehole, and will slidingly engage the wall when the cam is displaced in the other direction along the borehole; and, b) actuator means operatively connected to the cam and configured to, i) when activated in a first direction, displace the cam in said one direction, the arcuate portion slidingly engaging the borehole wall, and, ii) when activated in a second direction, displace the cam in said other direction, thereby locking the arcuate portion against the borehole wall.

2. The apparatus of claim 1, comprising a pair of said cams, each cam having a respective actuator means operatively connected thereto.

3. The apparatus of claim 1, wherein the cam comprises a pair of opposing members pivotally mounted to the support member, each opposing member having a said arcuate portion.

4. The apparatus of claim 3 wherein the biasing means comprises two elements each having a first end attached to the support member and a second end attached to a respective said opposing member.

5. The apparatus of claim 3 wherein the biasing means comprises a single member having a first end attached to one opposing member and a second end attached to the other opposing member.

6. The apparatus of claim 1 wherein the cam has a plurality of studded members attached to the arcuate portion of the cam.

7. A method of conveying at least one logging tool through an earth formation traversed by a horizontal or deviated borehole, the method comprising the steps of:

a) providing the conveyance apparatus of claim 1;

b) connecting the conveyance apparatus to the logging tool;

c) activating the actuator means to pull the cam backward thereby locking the arcuate portion against the borehole wall;

d) activating the actuator means to displace the cam in a forward direction; and, e) repeating steps (c) and (d), with the arcuate portion biased against the borehole wall, until the logging tool is conveyed to a predetermined position.

8. The method of claim 7, wherein the conveyance apparatus has a pair of cams, each cam having a respective actuator means operatively connected to the cam.

9. The method of claim 8, steps (c) and (d) comprising:

i) simultaneously activating each actuator means to displace each cam backward thereby locking the arcuate portion against the borehole wall; and then ii) sequentially activating each actuator means to displace each cam in a forward direction.

10. The method of claim 8 wherein the pair of cams are simultaneously operated, steps (c) an (d) comprising:

i) activating one of the actuators to displace one came in a forward direction; while ii) simultaneously activating the other actuator to pull the other cam backward thereby locking the arcuate portion against the borehole wall; then iii) activating the actuator of step (ii) to displace the cam of step (ii) in a forward direction; while iv) simultaneously activating the actuator of step (i) to pull the cam of step (i) backward thereby locking the arcuate portion against the borehole wall.

11. The method of claim 8, steps (c) and (d) comprising:

i) urging one cam against the borehole wall;

ii) activating the other actuator to displace the other cam in a forward direction;

iii) activating the actuator of step (ii) to pull the cam of step (ii) backward thereby locking the arcuate portion against the borehole wall; and, iv) repeating steps (ii) and (iii) until the logging tool is conveyed to a predetermined position.

12. The method of claim 11 wherein the cam of step (i) is urged against the borehole wall using a biasing means.

13. An apparatus for conveying at least one logging tool through an earth formation traversed by a horizontal or deviated borehole, comprising a support member; and two individually operable actuators for propelling the tool along the borehole, each actuator attached to the support member and comprising an engaging surface exposed for engaging a wall of the borehole in a manner that, while biased against the wall, the surface will be locked against the wall when the surface is displaced in one direction along the borehole, and will slidingly engage the wall when the surface is displaced in the other direction along the borehole; and means for biasing said surface against the borehole wall; and means for linearly displacing the engaging surface, with respect to the support member, in both directions along the borehole, the two actuators configured to be operated individually to cooperatively convey the logging tool along the borehole.

14. The apparatus of claim 13, wherein the two actuators are arranged and configured to convey the logging tool at a constant velocity along the borehole while being individually extended and retracted in multiple cycles.

15. A method of conveying a logging tool through an earth formation traversed by a horizontal or deviated borehole, comprising the steps of:

connecting the conveyance apparatus of claim 13 to the logging tool and inserting the tool into a borehole; and then operating one of the displacing means to move its respective engaging surface in one direction along the borehole, while operating the other of the displacing means to move its respective engaging surface in an opposite direction along the borehole.

16. The method of claim 15, wherein the logging tool is conveyed along the borehole at a constant velocity.

* * * * *